US005451718A

United States Patent [19]

Dixon

[11] Patent Number: 5,451,718

[45] Date of Patent: Sep. 19, 1995

[54] MECHANICALLY BONDED METAL SHEATH FOR POWER CABLE

[75] Inventor: Mark D. Dixon, Carrollton, Ga.

[73] Assignee: Southwire Company, Carrollton, Ga.

[21] Appl. No.: 43,717

[22] Filed: Apr. 8, 1993

[51] Int. Cl.[6] ..... H01B 7/22

[52] U.S. Cl. ..... 174/102 R; 156/54; 174/23 R; 174/107

[58] Field of Search ..... 174/102 R, 107, 23 R, 174/106 SC, 109; 156/53, 54

[56] References Cited

U.S. PATENT DOCUMENTS

| | | | |
|---|---|---|---|
| Re. 30,228 | 3/1980 | Silver et al. | 174/36 |
| 925,317 | 6/1909 | Eldred et al. . | |
| 2,018,939 | 10/1935 | Wertzheiser et al. | 247/43 |
| 2,259,850 | 10/1941 | Zundorf | 174/106 |
| 3,073,889 | 1/1963 | Moore | 174/102 R |
| 3,662,090 | 5/1972 | Grey | 174/107 |
| 3,720,994 | 3/1973 | Wagele | 174/107 X |
| 3,766,645 | 10/1973 | Ziemek | 174/102 R |
| 3,790,697 | 2/1974 | Buckingham | 174/102 |
| 3,912,850 | 10/1975 | Bruno et al. | 174/28 |
| 4,145,567 | 3/1979 | Bahder et al. | 174/107 |
| 4,569,704 | 2/1986 | Bohannon, Jr. et al. | 174/107 X |
| 4,729,629 | 3/1988 | Saito et al. | 174/107 |
| 4,830,689 | 5/1989 | Ramsey et al. | 174/102 D X |
| 5,006,670 | 4/1991 | Plant | 174/106 SC |

FOREIGN PATENT DOCUMENTS

| | | | |
|---|---|---|---|
| 594919 | 9/1925 | France | 174/102 R |
| 640779 | 7/1928 | France | 174/102 R |
| 1540460 | 1/1970 | Germany | 174/107 |
| 444929 | 2/1968 | Switzerland | 174/107 |
| 828177 | 2/1960 | United Kingdom | 174/102 R |

*Primary Examiner*—Morris H. Nimmo
*Attorney, Agent, or Firm*—Stanley L. Tate; James W. Wallis, Jr.

[57] ABSTRACT

A power cable for use in high moisture and chemically corrosive environments has a longitudinally-folded sheath for encapsulating one or more electrical conductors. A plurality of overlapping folds at the longitudinal edges of the sheathing material creates a labyrinth-type sealing joint for maintaining moisture and gas integrity of the cable. A sealant is provided within the circumferential and radial spaces defined by the overlapping folds of the joint.

14 Claims, 2 Drawing Sheets

MECHANICALLY BONDED METAL SHEATH FOR POWER CABLE

FIELD OF THE INVENTION

The present invention relates to an electrical power cable, and more particularly to an electrical power cable provided with a protective sheath having a labyrinth-type folded crimp formed along a longitudinal seam of the sheath, which is particularly adapted for use in high moisture or chemically corrosive environments.

BACKGROUND OF THE INVENTION

Electrical power cables enclosed in a protective outer sheath or tube are well known. The protective sheath is generally intended to withstand impact damage and, just as importantly, corrosive damage generated by moisture- or corrosive chemical-laden environments in which the cable is installed. Depending on its particular construction and application, the cable sheath may be designed to provide a liquid- and gas-tight enclosure for use in such hazardous environments. Accordingly, it is important that the sheath remain intact under all anticipated service conditions to maintain structural integrity of the cable and prevent detrimental intrusion of moisture or corrosive chemicals into the cable.

Generally, continuously-welded sheathed power cables are comprised of an assembly of insulated conductors enclosed in a flexible outer sheath. A filler material is provided between the conductors and the sheath to stabilize and isolate the conductors one from another and to provide some measure of electrical insulation to each conductor. An important problem, however, is that a breach of the outer sheath of the prior art undesirably enables entry and migration of moisture and other corrosive agents into the interior of the cable and along the length of each conductor, detrimentally affecting cable performance and longevity.

Various approaches have been taken to provide a strong, durable, and leak-tight sheath for power cables. For example, the sheath of a power cable disclosed in U.S. Pat. No. 3,766,645 is closed by forming the longitudinal edges of the sheath into a radially outwardly extending tab-like seam along the length of the cable. After the tab is trimmed to a uniform radial height, the cut edges of the tab are joined by a weld bead to seal the enclosure and to maintain electrical continuity of the sheath. The tab is then bent over to circumferentially abut the outer periphery of the cable.

An important problem with this approach is that discontinuities in the single weld bead may allow infiltration of moisture and other undesirable corrosive agents and gases into the cable.

According to a second approach, disclosed in U.S. Pat. No. Re. 30,228, an overlapping seam of a corrugated tape extends in a longitudinal direction of the cable. According to this approach, the longitudinal edges of the tape overlap one another without a crimp or fold. Fluid and gas integrity of this cable is provided solely by an outer coating of polyethylene or the like, rather than by the overlapping tape edges. Thus, the seam of this patent does not, by itself, provide a moisture- and gas-tight enclosure.

A third approach, disclosed in U.S. Pat. No. 3,662,090, includes a longitudinal tape seam which is folded over with a single fold, the seam then being compressed to a thickness less than that of the remainder of the tape. According to this patent, the fold must provide permanent contact between the overlying tape folds to maintain electrical continuity across the seam. Any non-conductive coating provided between the overlying tape folds could adversely affect the required electrical continuity of the assembled cable.

Yet another approach disclosed in U.S. Pat. No. 4,830,689 comprises a metal sheath having pre-bent, longitudinally-extending edges which cooperatively overlap to form, in cross-section, a trapezoidal joint. An adhesive material is provided within that joint to adhere the sheath edges together, while forming a leak-tight sheath closure. A problem with this approach, however, is that the strength and fluid integrity of the sheath closure is derived solely from the strength, volume, and distribution of the adhesive material because there is no substantial mechanical connection made between the overlapping sheath edges.

A further approach, disclosed in U.S. Pat. No. 3,073,889, provides a metal tape configured into a protective sheath about an electrical cable. The lateral edges of the tape are formed into a box seam along the longitudinal extent of the cable, followed by a coating of a thermoplastic material applied to the entire periphery of the cable assembly to provide an outer hermetic seal thereto. A thermoplastic filament is provided at the radially inner side of the box seam, and when heated, flows only to the immediate vicinity of the meeting edges of that portion of the box seam and between the conductors adjacent to the box seam.

SUMMARY OF THE INVENTION

It is an object of the present invention to provide a metal sheath closure for an electrical power cable which is impermeable to liquid and gas intrusion.

It is another object of the present invention to provide a metal sheath closure for an electrical power cable which provides substantial impact protection to the cable during installation and operation of the power cable.

It is a further object of the present invention to provide a metal sheath closure for an electrical power cable which requires no welding or heating concurrent with the fabrication thereof necessary to establish the desired fluid-impermeable and impact-resistant properties.

It is yet another object of the present invention to provide a fluid-impermeable sheath for an electrical cable with a longitudinal crimped mechanical seam sealed along the contacting surfaces thereof.

The present invention provides an improved closure for an outer metal sheath for an electrical power cable formed from a metal tape. The outer metal sheath encloses a plurality of electrical conductors, insulation shields, and thermoplastic filler material to form a strong, environmentally isolated power cable assembly. In particular, the invention provides a labyrinth-type folded crimp formed from the overlapping longitudinal edges of the tape into an interlocking joint, the folded crimp being formed at the outer periphery of the power cable. The tape is preferably comprised of aluminum, copper, alloys thereof, or steel. After the tape edges have been fully engaged along the longitudinal extent of the cable, the joint is compressed or crimped into the folded crimp for maintaining moisture and gas integrity of the power cable. The folds of the partially-compressed folded crimp define three circumferentially-extending internal spaces running the length of the cable, joined by three radially-extending internal spaces in a serpentine path. The fully formed interlocking joint provides substantial impact and burst strength to the power cable. A sealant is provided in one or more spaces of the serpentine path of the folded crimp to provide an additional barrier to undesirable intrusion of moisture and chemical corrosive agents. When fully compressed, the folded crimp contains the sealant in the two fully-enclosed radial internal spaces thereof, with substantial metal-to-metal contact achieved throughout the remainder to the serpentine path. An elastomeric coating is then applied to the sealed sheath to provide an additional environmental barrier and to complete the cable construction.

A method for forming the folded crimp includes the steps of bringing the tape edges together, applying a sealant bead to the tape edges and folding the longitudinal tape edges in sequence to create the interlocked structure of the joint, containing internal spaces in which sealant is retained during the folding sequence and after the joint is crimped.

With the foregoing and other objects, advantages and features of the folded crimp of the invention that will become hereinafter apparent, the nature of the invention may be more clearly understood by reference to the following detailed description of the invention, the appended claims, and to the several views illustrated in the attached drawings.

DETAILED DESCRIPTION OF THE INVENTION

Figure 1:
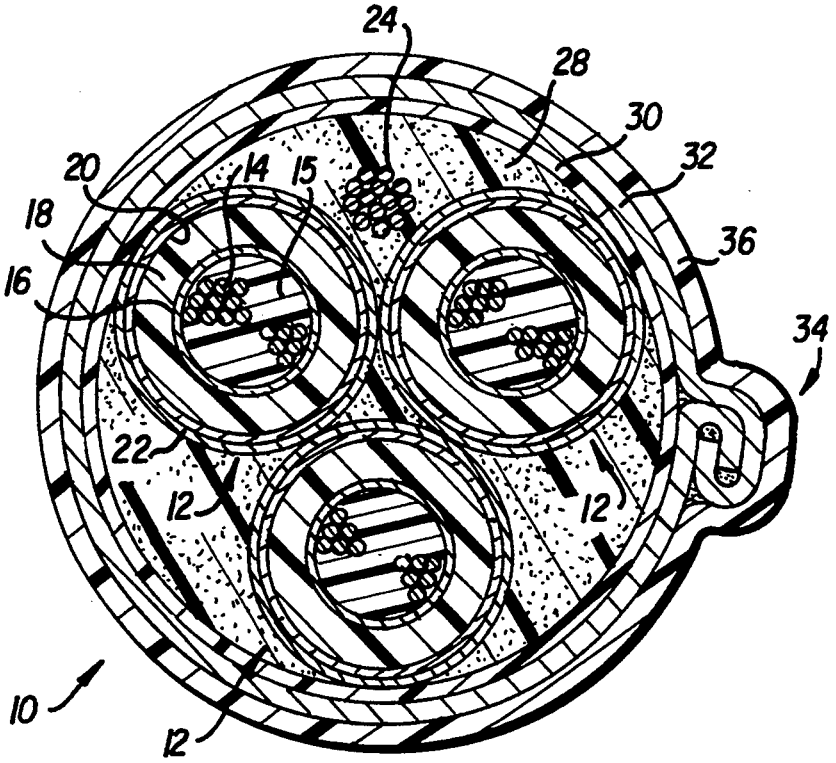
FIG. 1 is a cross-sectional view of a multiple-conductor electrical power cable provided with an encapsulating sheath shown assembled in a sealed condition by the labyrinth-type folded crimp of the present inventions.

Referring now in detail to the drawings wherein like parts are designated by like reference numerals throughout, there is illustrated in FIG. 1 a multiple conductor electrical power cable 10 secured in a fully assembled condition by the folded crimp of the present invention. More particularly, the power cable 10 includes a plurality of electrical conductors 12 each comprised of a plurality of electrically conductive strands or filaments 14 bundled in parallel alignment in which the interstices between the strands are filled with a moisture blocking compound 15. A strand shield 16 surrounds and encloses each bundle of strands 14. A layer of insulation 18 surrounds each shielded strand bundle. An insulation shield 20 surrounds the insulation 18, and in turn is surrounded by a copper tape shield 22.

A neutral or ground strand bundle 24 is disposed between any two of the three assembled electrical conductors 12 as shown, and a matrix 28 of a spongy, semiconductive thermoplastic material encapsulates the three electrical conductors 12 and the neutral strand bundle 24. This material accommodates the thermal expansion of the conductors 12 caused by resistive heating when electricity is applied to the cable. A water-swellable moisture block tape 30 encloses the assembly of the electrical conductors 12, neutral strand bundle 24, and thermoplastic matrix 28. The moisture block tape 30 may be either electrically semiconductive or insulative, and separates the internal components of the power cable assembly from an outer metal tape sheath 32. According to the preferred embodiment of the present invention, the tape sheath 32 has a nominal thickness of 25–32 mils. The power cable 10 is then enclosed by joining the longitudinal edges of the tape sheath 32 at a folded crimp 34 providing improved mechanical and fluidic protection according to the present invention, as will be more fully described below. Finally, a jacket 36, such as extruded PVC plastic, is applied to the sealed tape sheath 32 and folded crimp 34 to fully encapsulate the power cable assembly.

Figure 2:
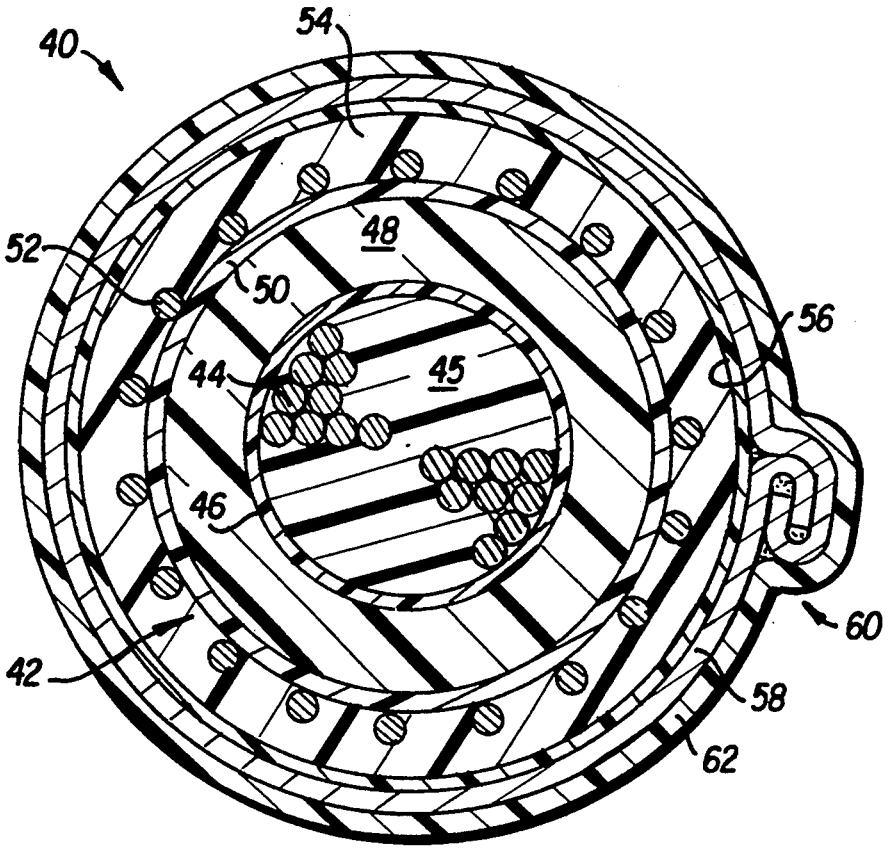
FIG. 2 is a cross-sectional view of a single-conductor electrical power cable also shown with the labyrinth-type is folded crimp of the present invention.

A single conductor power cable 40 is shown secured in a fully assembled condition in FIG. 2. This power cable 40 includes a central electrical conductor 42 comprised of a plurality of electrically conductive strands or filaments 44 bundled in parallel alignment with a moisture block compound 45 filling the interstices between the strands 44. A first strand shield 46 surrounds and encloses the central conductor 42. A layer of insulation 48 surrounds the first strand shield 46, which in turn is surrounded by a second insulation shield 50 to complete the assembly of the central conductor 42.

A plurality of circumferentially spaced copper neutrals or grounds 52 are provided on the outer diameter of the second insulation shield 50, all of which is then encompassed by a matrix 54 of thermally expansive thermoplastic material. A water-swellable moisture block tape 56 encloses the assembly of the central conductor 42, neutrals 52, insulation strand shield 46 and second insulation shield 50 and thermoplastic matrix 54. The moisture block tape 56 may be either electrically semiconductive or insulative, and separates the internal components of the power cable assembly from an outer metal tape sheath 58. As previously described, the thermoplastic matrix 54 is provided in the form of a cushioning layer to absorb radial expansion and contraction of thermally unmatched components of the assembled power cable 40. The power cable 40 is then enclosed by joining the longitudinal edges of the tape sheath 58 at a folded crimp 60. A thermoplastic jacket 62, such as PVC, is applied to the sealed tape sheath 58 and folded crimp 60 to fully encapsulate the power cable assembly.

According to the preferred embodiment of the present invention, the folded crimp 34, 60 of the electrical power cables 10, 40 is formed along the adjacent longitudinal edges of a rectangular tape strip 32 after the tape strip has been wrapped about the moisture block tape 30, 56 of either power cable embodiment 10, 40, respectively. The tape strip 32 is preferably comprised of aluminum, copper, alloys thereof, or steel.

Figure 3:
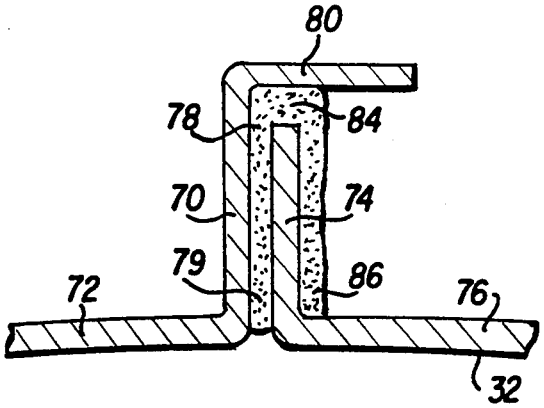
FIG. 3 is a cross-sectional view of the first formative step of the folded crimp of the present invention, showing a first layer of sealant provided between abutting, folded sections of the longitudinal edges of the sheathing material.

With reference to FIG. 3, a first edge 70 is prebent from a first longitudinal tape side 72 into a generally S-shaped configuration prior to wrapping of the tape about the cable. In like manner, a second edge 74 is bent from a second longitudinal tape side 76 into an L-shaped configuration such that the two edges 70, 74 are brought into abutting, overhanging relationship when the tape strip is wrapped about the cable, with an outer portion 80 of the first edge 70 overlapping and extending beyond the second edge 74 in a direction substantially circumferentially to the second tape side 76. A sealant 78 is applied in the spaces 79, 84, 86 between the edges 70, 74 prior to or at the time the edges 70, 74 are brought together to the position shown in FIG. 3. The sealant 78 may be any suitable sealant but is preferably a conventional moisture-blocking, chemically-resistant sealant and may include a water-swellable compound, if desired.

Figure 4:
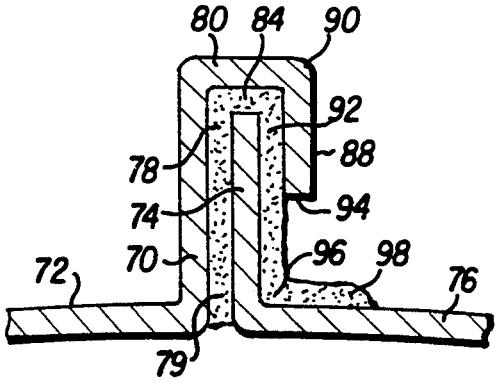
FIG. 4 is a cross-sectional view of the second formative step of the crimp of the present invention, showing a complete bracketing of one longitudinal edge about the other, with the sealant provided therebetween.

With reference now to FIG. 4, the free end 88 of the outer portion 80 is folded to form a right angle corner 90 to fully enclose the second edge 74 and create further sealant-filled spaces 92 and 96 therebetween. Concurrently, some of the sealant 78 is forced out of the spaces 92 and 96 and forms a layer 98 on the outer surface of second tape side 76.

Figure 5:
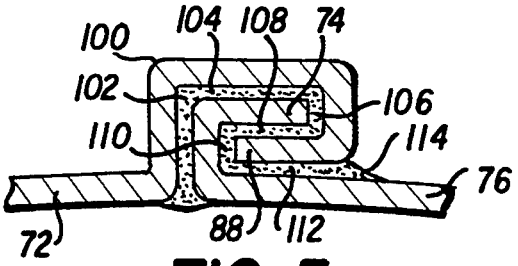
FIG. 5 is a cross-sectional view of the crimp after completion of a folding step, showing the location of the sealant extending from the radially innermost circumferential space of the crimp to the outer periphery of the sheath.

As seen in FIG. 5, the partially folded structure is then folded in its entirety approximately 90 degrees clockwise about a point 100 located at a radially intermediate distance along the first edge 70. This folding operation reorients the folded structure and substantially bisects the original space 79 into a first radial space 102 and a first circumferential space 104. Likewise, original space 84 becomes a second radial space 106. In like manner, original space 92 becomes a second circumferential space 108, and original space 96 becomes a third radial space 110. Finally, the space formed between the outer surface of free end 88 (FIG. 4) and the second tape side 76 becomes a third circumferential space 112. The sealant 78 and 98 extrudes out of the crimped joint to form beads 114, 116 at the innermost and outermost junctures of the tape sides 72, 76.

Figure 6:
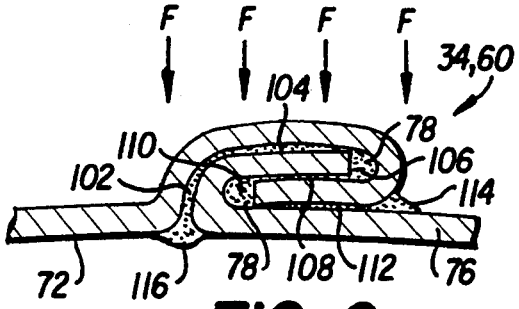
FIG. 6 is a cross-sectional view of the crimp after application of a radially inwardly directed force to the fully formed crimp shown in FIG. 5, further showing the compressed internal spaces of the crimp and a redistribution of the sealant therein.

After the tape edges have been fully engaged along the longitudinal extent of the cable, the joint is compressed, crimped, or drawn radially inwardly by a force F into the desired configuration for maintaining moisture and gas integrity of the power cable as shown in FIG. 6. During this compression step, the sealant is redistributed throughout the folded crimp 34, 60 to provide further fluid-tight integrity thereto and provide substantial impact and burst strength to the fully assembled power cable. Although three radial internal spaces 102, 106, 110 and three circumferential internal spaces 104, 108, 112 are shown in FIG. 6 to contain the redistributed sealant, it will be apparent to the skilled artisan that a sufficient crimping force may cause the sealant to accumulate in selected ones of the radial and circumferential internal spaces. For instance, a sufficient radially inward force F applied to the crimp to cause full compression thereof will result in the fully compressed configuration shown in FIG. 7. In this configuration, substantially all of the sealant flows to and is contained within the renumbered second and third radial internal spaces 106, 110 resulting in substantial metal-to-metal contact between the adjacent joint layers of the remainder of the crimp. Sealant from the first radial space 102 and the third circumferential space 112 form sealant beads 114, 116 insuring further moisture- and gas-tight integrity of the crimped joint.

Figure 7:
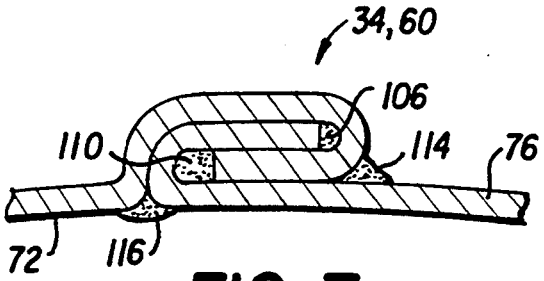
FIG. 7 is a cross-sectional view of the crimp after full compression of the folded crimp in a radially inward direction.

Accordingly, it is within the purview of the present invention that a force of selected direction and magnitude applied against a selected location of the partially or fully formed but uncompressed crimp of FIG. 5 will yield a compressed crimp having predetermined sealing characteristics depending on the redistribution of the sealant and any wall-to-wall contact of the opposing longitudinal tape edges 70, 74 of the compressed crimp. As will be appreciated, sealant fluid flow will occur by direct pressure application through the folds of the sheath tape such that a complete, redundant seal is established by the physical configuration of the tape folds and the accumulated sealant distributed throughout those tape folds as shown in FIGS. 6 and 7. The elastomeric coating 36, 62 is then applied to the sealed sheath to provide an additional environmental barrier and to complete the cable construction. It is further contemplated that the folded crimp of the present invention is useful for sealing electrical power cables having a finished diameter range extending up to about 4.00 inches with a non-corrugated sheath tape.

Although only a preferred embodiment of the sheath crimp of the present invention has been specifically described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. An electrical power cable comprising at least one electrical conductor, an insulator surrounding the conductor, and a sheath enclosing the conductor and insulator, said sheath including longitudinally extending first and second edges overlapping each other and folded together in an interconnected, serpentine joint with a plurality of opposing circumferential faces, the first and second edges each being circumferentially spaced in non-contacting, confronting relation to said sheath and forming first and second radial spaces between said first and second edges and said sheath, all said opposing faces of said joint being in substantially complete metal-to-metal contact, and a sealant provided in said first and second radial spaces.

2. The electrical power cable of claim 1, said joint having an additional radial space between said insulator and said sheath and three internal circumferential spaces relative to the longitudinal axis of the cable.

3. The electrical power cable of claim 1, wherein the sheath comprises a metal tape selected from the group of aluminum, copper, or steel.

4. An electrical power cable comprising at least one electrical conductor, an insulator surrounding the conductor, and a sheath surrounding the conductor and insulator in sealing relationship, said sheath including a pair of longitudinally extending edges overlapped with each other in an interconnected joint along the longitudinal extent of the cable, said joint having at least two internal radial spaces relative to the longitudinal axis of the cable, wherein said overlapping edges make substantially complete metal-to-metal contact, and a sealant disposed in each of said two radial spaces along with the cable length and wherein substantially all of said sealant is received in said two radial spaces when said interconnected joint is compressed into a final compressed-joint configuration.

5. The electrical power cable of claim 4, wherein said joint comprises three circumferential spaces and three radial spaces defining a contiguous serpentine space before the interconnected joint is compressed into said final compressed-joint configuration, and wherein the sealant is contained in substantially only the three radial spaces in the final compressed-joint configuration.

6. The electrical power cable of claim 4, wherein said sealant is a moisture resistant sealant.

7. The electrical power cable of claim 4, wherein the sheath comprises a metal tape selected from the group of aluminum and its alloys, copper and its alloys, and steel.

8. The electrical power cable of claim 7, wherein the sheath is between about 0.0025 to about 0.0032 inches in thickness.

9. A method of making an electrical power cable having at least one electrical conductor, an insulator surrounding the conductor, and a sheath having longitudinal first and second edges extending along the length of the cable, comprising the steps of:

(a) longitudinally wrapping the sheath about the circumference of the cable;

(b) folding the first and second longitudinal edges into abutting relationship having a first portion of one of said edges overlapping the radially outermost tip of said second edge at a substantially right angle thereto;

(c) providing a sealant between said abutting edges along the cable length;

(d) folding said overlapping edge to direct said first folded edge tip radially inwardly in substantially parallel orientation to said second folded edge;

(e) folding the structure of step (d) about an intermediate section of the remaining radially outer portion of the first folded edge through an angle of about 90 degrees to bring the first folded edge tip of step (d) into substantially parallel orientation with the outer circumference of the sheath along the cable length to form joint with a serpentine joint with a plurality of opposing circumferential faces, the first and second edges each being circumferentially spaced in non-contacting, confronting relation to said sheath and forming first and second radial spaces between the first and second edges and said sheath; and (f) compressing the structure of step (e) in a radially inward direction along the cable length whereby the sealant flows to and is retained in the two radial spaces adjacent to the first and second edges, and causing substantially complete metal-to-metal contact between the opposing faces of said joint.

10. The method of making an electrical power cable of claim 9, further comprising the step of folding the structure of step (e) to form a joint having three internal radial and three internal circumferential spaces relative to the longitudinal axis of the cable.

11. The method of making an electrical power cable of claim 9, further comprising the step of compressing the structure of step (f) to flow the sealant in a substantially unbroken stream through the spaces defined by said folded structure.

12. The method of making an electrial power cable of claim 9, further comprising the step of providing a sealant to a gap separating the outer surface of the structure of step (f) from an outer surface of an unfolded portion of the sheath adjacent thereto, said sealant extending along the length of the cable.

13. The method of making an electrical power cable of claim 9, further comprising the step of providing a sealant at an additional radial space between the insulator and the first and second edges of the sheath, said sealant extending to said insulator.

14. The method of making an electrical power cable of claim 9, further comprising the step of encapsulating the cable with an elastomeric coating.

* * * * *